US009931001B2

(12) United States Patent
Cohen

(10) Patent No.: US 9,931,001 B2
(45) Date of Patent: Apr. 3, 2018

(54) SOAP DISPENSER

(71) Applicant: Shlomo Cohen, Modiin (IL)

(72) Inventor: Shlomo Cohen, Modiin (IL)

( * ) Notice: Subject to any disclaimer, the term of this patent is extended or adjusted under 35 U.S.C. 154(b) by 0 days.

(21) Appl. No.: 15/151,473

(22) Filed: May 10, 2016

(65) Prior Publication Data

US 2016/0249775 A1 Sep. 1, 2016

Related U.S. Application Data

(63) Continuation-in-part of application No. PCT/IL2014/050980, filed on Nov. 11, 2014.

(30) Foreign Application Priority Data

Nov. 14, 2013 (IL) ..... 229429

(51) Int. Cl.
*A47K 5/12* (2006.01)
*B05B 11/00* (2006.01)

(52) U.S. Cl.
CPC ..... *A47K 5/1211* (2013.01); *A47K 5/1205* (2013.01); *B05B 11/0089* (2013.01); *B05B 11/3047* (2013.01); *A47K 2005/1218* (2013.01)

(58) Field of Classification Search
CPC ..... A47K 5/1211; A47K 5/1205; A47K 2005/1218; A47K 5/12; A47K 5/1202;
(Continued)

(56) References Cited

U.S. PATENT DOCUMENTS 2,529,407 A * 11/1950 Midouhas ..... A45D 44/02 222/129
2,681,549 A * 6/1954 Maxwell ..... B67D 1/06 222/146.1

(Continued)

FOREIGN PATENT DOCUMENTS

DE 20006681 U1 9/2000
DE 10042401 A1 3/2002

OTHER PUBLICATIONS

Hansgrohe Price Book 2012/2013, Chapter 32 "Axor Carlton," p. 32.15, Liquid Soap Dispenser, Catalogue No. 41419000/41419090, Online cite at http://www.voniosidejos.lt/app/webroot/files/2013HG-AXORkainynas.pdf, p. 609.

(Continued)

*Primary Examiner* — Charles P Cheyney
(74) *Attorney, Agent, or Firm* — Haim M. Factor; 1st-Tech-Ideas.com

(57) ABSTRACT

The present invention provides a housingless liquid soap dispenser, comprising: a) an elongated chamber in which liquid soap is contained, wherein the length of the chamber is at least 25 cm and its width or diameter is ranging from 28-45 mm; b) a shoulder protruding laterally from the chamber at an upper end thereof; c) a neck portion extending upwardly from the shoulder; d) a manual pumping device fitted on top of the neck portion and in fluid communication with the chamber; and e) a discharge tube extending from the pumping device for dispensing a dose of liquid soap from the chamber. The shoulder has a slanted profile for enhancing the stability of the dispenser after its installation in removable abutting relation with, but not coupled to, a planar support surface of a countertop or a sink, such that the shoulder rests on top of the support surface while the (Continued)

chamber is inserted by a maximum extent through an aperture formed in the support surface.

8 Claims, 4 Drawing Sheets

(58) Field of Classification Search
CPC ..... A47K 5/1204; B05B 11/0089; B05B 11/3047; B05B 11/3001; B05B 11/0005; B05B 11/3052; B05B 11/306; B05B 11/0097
USPC ..... 222/180, 321.1–321.9, 192, 325, 173, 222/383.1, 181.2; 4/628
See application file for complete search history.

(56) References Cited

U.S. PATENT DOCUMENTS 2,751,127 A * 6/1956 Horald ..... A47K 5/12 222/386.5
2,885,125 A * 5/1959 Russell ..... B05B 11/0013 222/180
3,128,018 A 4/1964 Corsette
4,280,638 A * 7/1981 Keihm ..... A47K 5/12 222/180
4,516,676 A * 5/1985 Cournoyer ..... A47L 1/06 206/225
5,148,948 A * 9/1992 Granville ..... A47K 5/12 222/153.09
5,209,377 A 5/1993 Steiner et al.
5,350,087 A 9/1994 Frazier et al.
5,476,197 A * 12/1995 Lawrence ..... A47K 5/1211 222/180
5,881,918 A * 3/1999 Eichler ..... B05B 11/3084 222/135
6,431,405 B2 * 8/2002 Irwin ..... 222/192
6,748,966 B1 * 6/2004 Dvorak ..... E03C 1/102 137/216
8,371,479 B2 * 2/2013 Luft ..... B05B 11/00 206/226
8,479,957 B2 * 7/2013 Ophardt ..... A47K 10/3818 222/144
8,800,815 B1 * 8/2014 Butler ..... A47K 5/1208 141/114
9,402,454 B2 * 8/2016 Landy ..... A45D 34/00
9,462,917 B2 * 10/2016 Licari ..... A47K 5/12
2002/0189674 A1 * 12/2002 Meeder ..... E03C 1/0401 137/359
2004/0060109 A1 * 4/2004 Hensley ..... E03C 1/04 4/675
2004/0164102 A1 * 8/2004 Green ..... B05B 11/0091 222/321.7
2005/0155988 A1 * 7/2005 Meehan ..... A47K 1/08 222/321.7
2010/0072228 A1 3/2010 Spears
2013/0001243 A1 * 1/2013 Quick ..... A47K 3/285 222/135
2015/0108168 A1 * 4/2015 Truedsson ..... A47K 5/1205 222/153.13

OTHER PUBLICATIONS

Hansgrohe—Axor "Price Book 2012/2013"; http://www.voniosidejos.lt/app/webroot/files/2013HG-AXORkainynas.pdf.
International Search Report for PCT/IL2014/050980, dated Mar. 1, 2015.
Written Opinion for PCT/IL2014/050980, dated Mar. 1, 2015.

* cited by examiner

SOAP DISPENSER

CROSS-REFERENCE TO RELATED APPLICATIONS

This application is a Continuation-In-Part of PCT/IL2014/050980 filed Nov. 11, 2014, which claims priority to Israeli application No. 229429 filed Nov. 14, 2013, the disclosure of both applications being incorporated herein by reference in their entireties.

FIELD OF THE INVENTION

The present invention relates to the field of soap dispensers. More particularly, the invention relates to a disposable soap dispenser.

BACKGROUND OF THE INVENTION

Many disposable liquid soap dispensing units are known from the prior art. One type comprises an outlet nozzle located above a countertop or sink and a replaceable reservoir of liquid soap that is releasably connected to the dispensing mechanism below the sink. Such an arrangement is cumbersome while requiring one to bend below the sink in order to replace the reservoir, and is further prone to mechanical failure due to its many moving parts, rendering the dispensing unit useless.

In some prior art liquid soap dispensing units, such as U.S. Pat. Nos. 5,209,377, 5,350,087 and US 2010/0072228, the liquid soap container is disposed above a countertop; however, a fixed member with which the dispensing unit is connected is required, adding to the cost of the dispensing unit.

It is an object of the present invention to provide a replaceable and above-counter mountable liquid soap dispenser that can reliably dispense a desired dose of soap.

It is an additional object of the present invention to provide a liquid soap dispenser that does not require any housing member.

Other objects and advantages of the invention will become apparent as the description proceeds.

SUMMARY OF THE INVENTION

The present invention provides a housingless liquid soap dispenser, comprising a chamber in which liquid soap is contained, a shoulder protruding laterally from said chamber at an upper end thereof, a neck portion extending upwardly from said shoulder, a manual pumping device fitted on top of said neck portion and in fluid communication with said chamber, and a discharge tube extending from said pumping device for dispensing a dose of liquid soap from said chamber, wherein said shoulder is in removable abutting relation with, but not coupled to, a substantially planar support surface, while said chamber is inserted by a maximum extent through an aperture formed in said support surface.

The support surface, when the shoulder is in abutting relation therewith, applies a reactive force during application of a user initiated force to the pumping device. The user initiated force is therefore transmitted to the support surface, allowing the chamber to remain stationary while precluding the need of a separate housing.

The soap dispenser is above-counter mountable, and is replaceable upon raising the pumping device. It is easily manipulatable, with an elongated chamber length of no more than 55 cm and a chamber width ranging from 28 to 45 mm, for maximizing the amount of soap to be retained therewithin.

DETAILED DESCRIPTION OF PREFERRED EMBODIMENTS

The present invention is a novel housingless liquid soap dispenser wherein the dispensing mechanism is in liquid communication with the soap container and is disposable.

Figure 1:
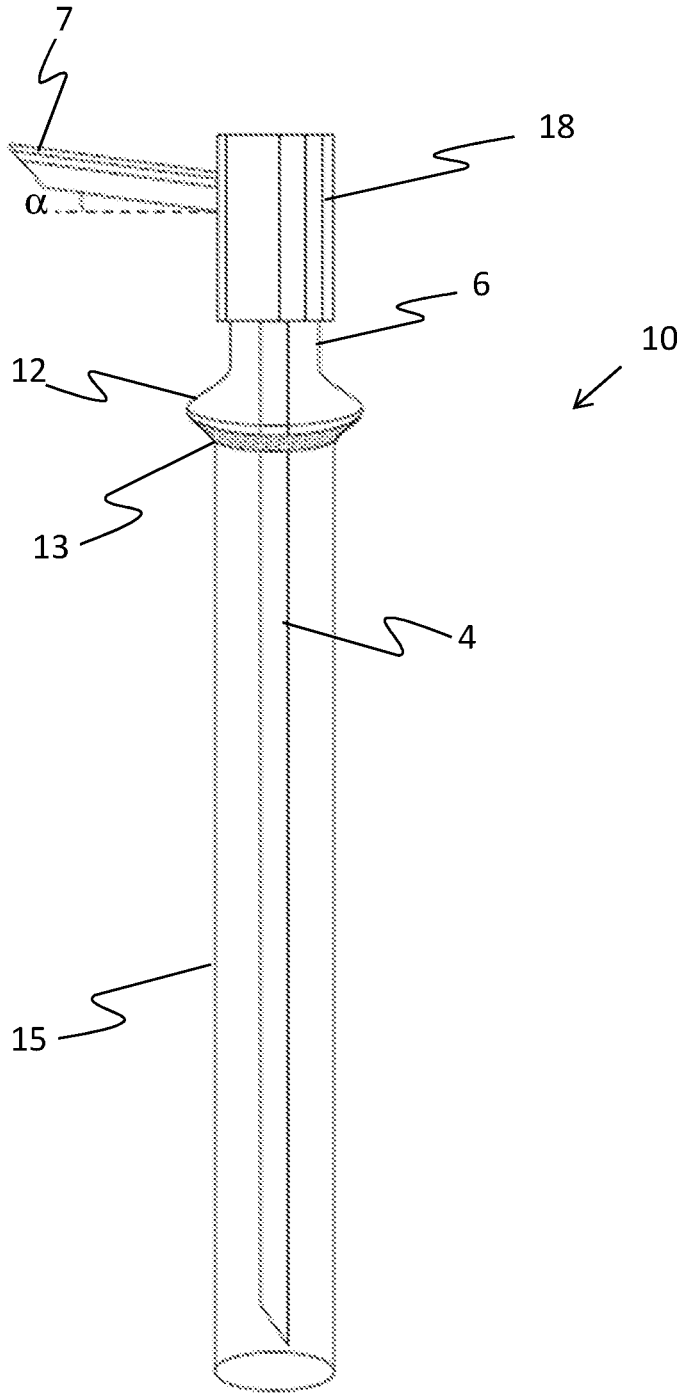
FIG. 1 is a side view of a liquid soap dispenser, according to one embodiment of the present invention.

FIG. 1 illustrates a disposable liquid soap dispenser according to one embodiment of the present invention, generally designated as numeral 10. Dispenser 10 comprises elongated chamber 15, e.g. of circular cross section, in which liquid soap is contained after having been factory injected therein, a shoulder 12 radially protruding from chamber 15 at an upper end thereof, a relatively narrow neck portion 6 extending upwardly from shoulder 12, manual pumping device 18 fitted on top of neck portion 6, and conduit 4 extending downwardly from pumping device 18 into chamber 15 and through which pressurized soap is drawn prior to being dispensed through discharge tube 7.

Soap chamber 15 and pumping device 18 may be made of a commercially available and inexpensive plastic material, such as PET or polyethylene. Soap chamber 15 is preferably transparent or translucent in order to be able to view the liquid soap level. The wall thickness of chamber 15 ranges from 0.3-1.2 mm, and is preferably 0.5 mm.

Figure 2:
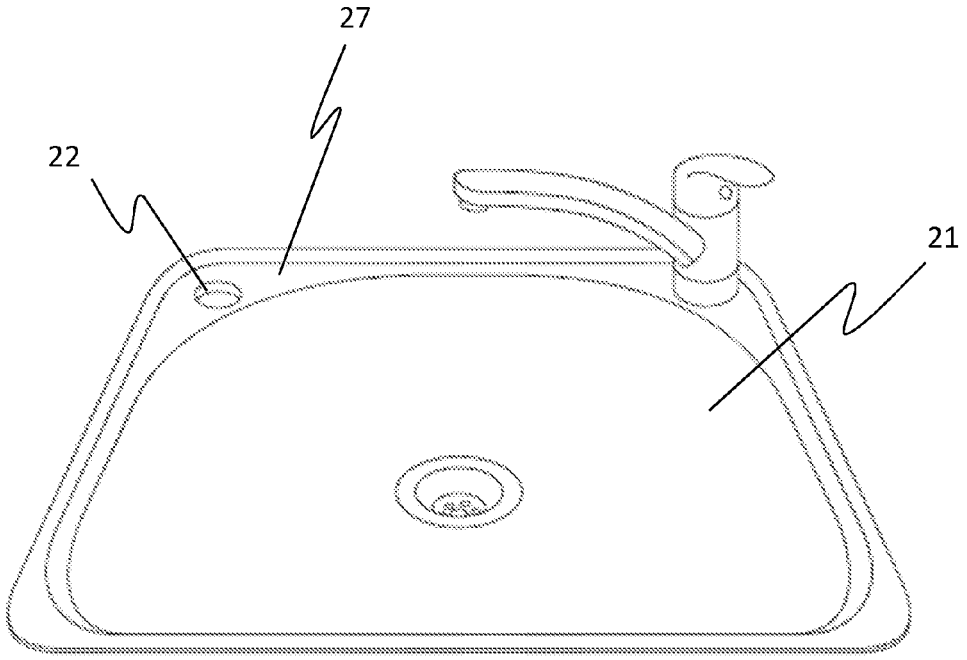
FIG. 2 is a perspective view from above of a sink, in a surface of which is formed an aperture for receiving the soap dispenser of FIG. 1.
Figure 3:
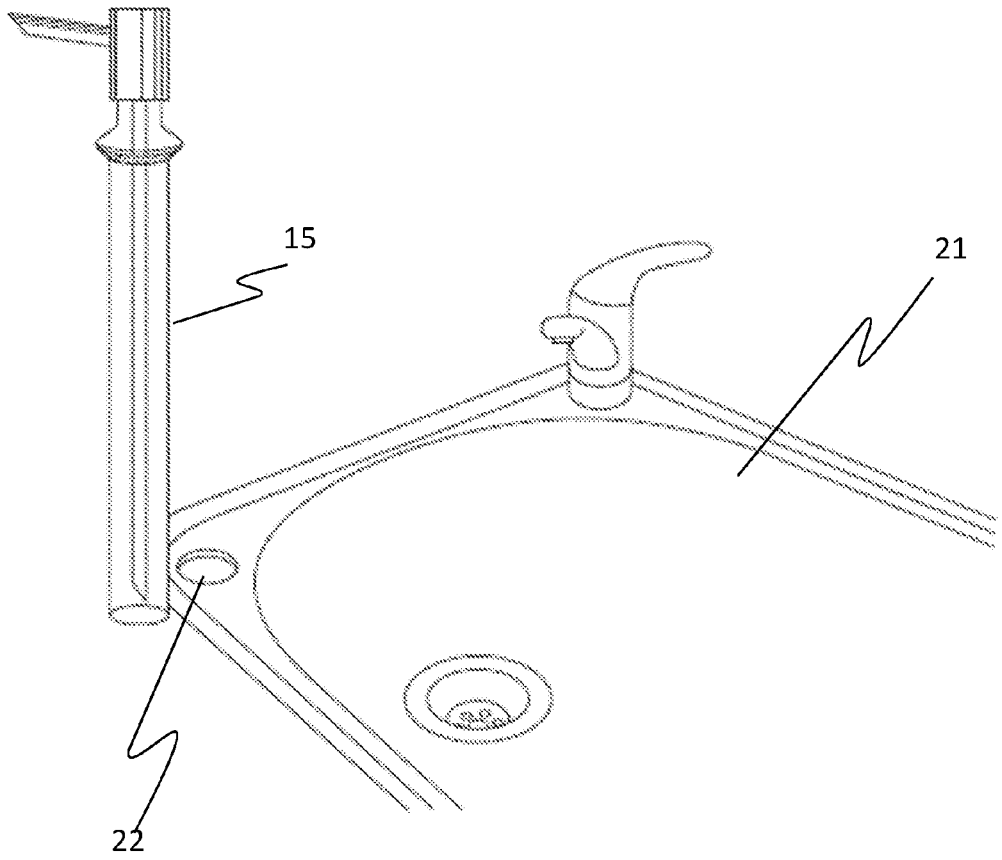
FIG. 3 is a perspective view from above of the sink of FIG. 2, showing the soap dispenser of FIG. 1 prior to being inserted within the aperture.
Figure 4:
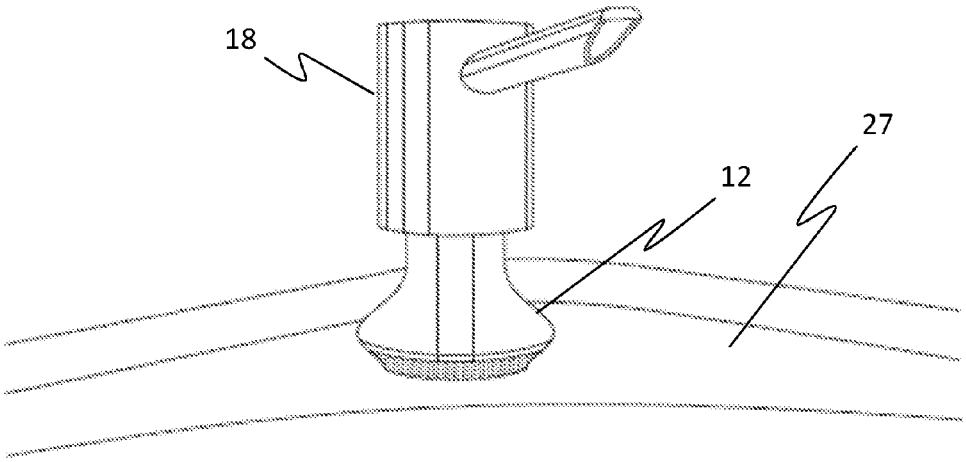
FIG. 4 is an enlarged perspective view from the side of the soap dispenser of FIG. 1, when in abutting relation with the sink of FIG. 2.

As shown in FIGS. 2-4, chamber 15 is insertable through an aperture 22 formed in a substantially planar surface 27 of a sink 21 as shown, or alternatively in a countertop. Aperture 22 is preferably shaped similarly to the cross section of chamber 15. After chamber 15 has been inserted through aperture 22 to a fullest extent, shoulder 12 rests on top of surface 27, in preparation for a soap dispensing operation. Since shoulder 12 having a slanted profile due to its conical-like form (as shown in FIG. 1) and is in abutting relation with surface 27, the latter applies a reactive force when a user initiated force is applied to pumping device 18. Thus the user initiated force will be transmitted to surface 27, allowing chamber 15 to remain stationary while precluding the need of a separate housing.

The bottom surface of shoulder 12 may be substantially planar, in order to increase contact between the shoulder and surface 27 and to thereby maximize transmission of the user initiated force to surface 27. According to an embodiment of the invention, an elastic layer 13 adapted to fit at least part of the bottom surface of shoulder 12 is provided. Such an elastic layer, which can be made of rubber, foam (e.g., double coated tape by 3M) may improve one or more of the following features:

creating an enhanced seal at the interface between the bottom surface of shoulder 12 and surface 27;

preventing scratches or other damages to surface 27;

enhancing the stability of the dispenser after the installation at the countertop or sink.

In order to replace the dispenser after all or most of the liquid soap has been dispensed, the dispenser is simply removed by raising it above surface 27 and a chamber of a different dispenser is lowered into aperture 22. As it is inexpensively manufactured, the original dispenser may be discarded.

The dimensions of chamber 15, i.e. a length of no more than 55 cm, e.g. ranging from 25-45 cm, and preferably 35 cm, and a width or diameter ranging from 28-45 mm, e.g. 34.9 mm, facilitate effortless manipulation thereof during a deployment or replacement procedure. Shoulder 12, which is slightly wider than chamber 15 in order to enable the dispenser to be above-counter mountable, has a width or diameter ranging from 30-55 mm, e.g. 40 mm.

Discharge tube 7 may be slightly upwardly inclined with respect to a horizontal plane passing through the longitudinal axis of chamber 15, to define an angle $\alpha$, which is greater than 0 degrees and may range from 10-25 degrees. By virtue of such an upward inclination, any residual soap remaining in discharge tube 7 after a soap dispensing operation is urged to return gravitationally to chamber 15. It will be appreciated, however, that dispenser 10 is also operable when discharge tube 7 is configured without an upward inclination, or even with a downward inclination.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A housingless disposable liquid soap dispenser, comprising:

a) an elongated cylindrical chamber in which liquid soap is contained, wherein the length of said chamber is at least 25 cm and the diameter of said chamber is ranges from 28-45 mm;

b) an integrated shoulder, protruding radially from said chamber at an upper end thereof the shoulder having a width ranging from 30 to 55 mm;

c) a neck portion extending upwardly from said shoulder, the neck portion having a diameter less than the diameter of the chamber;

d) a manual pumping device fitted on top of said neck portion, the pumping device positioned coaxially with the chamber and having only a conduit extending downwardly from the pumping device in fluid communication with said chamber; and e) a discharge tube extending from said pumping device for dispensing a dose of liquid soap from said chamber, wherein said shoulder has a slanted profile for enhancing the stability of the dispenser after installation thereof, in removable abutting relation with, but not coupled to a planar support surface of a countertop or a sink, such that said shoulder rests on top of said support surface after said chamber is inserted by a maximum extent through an aperture formed in said support surface, said aperture is circular and the chamber is of circular cross section wherein the removable abutting relation of the shoulder with the support surface constitutes the support for the soap dispenser without requiring any housing member, the soap chamber and pumping device being made of a disposable plastic material and the chamber being transparent or translucent, and wherein the dispenser is replaced upon raising the dispenser above said support surface, the dispenser discarded, and a replacement dispenser replacing the discarded dispenser.

2. The soap dispenser according to claim 1, further comprises an elastic layer adapted to fit at least part of said shoulder abutting said support surface, the elastic layer serving to prevent scratches or other damages to said support surface and to enhance stability of the dispenser at said support surface.

3. The soap dispenser according to claim 1, wherein the length of the chamber is no more than 55 cm.

4. The soap dispenser according to claim 3, wherein the length of the chamber ranges from 25 to 45 cm.

5. The soap dispenser according to claim 1, wherein a conduit through which pressurized soap is drawable extends downwardly from the pumping device into the chamber.

6. The soap dispenser according to claim 1, wherein the soap chamber has a wall thickness ranging from 0.3 to 1.2 mm.

7. The soap dispenser according to claim 1, wherein the discharge tube has an upward inclination, to urge any residual soap remaining in the discharge tube to return gravitationally to the chamber.

8. The soap dispenser according to claim 7, wherein the discharge tube is angled with respect to a horizontal plane passing through the longitudinal axis of the chamber by an angle ranging from 10 to 25 degrees.

* * * * *